US008643353B2

(12) United States Patent
Tong et al.

(10) Patent No.: US 8,643,353 B2
(45) Date of Patent: Feb. 4, 2014

(54) DRIVING VOLTAGE ADJUSTING CIRCUIT CAPABLE OF ADJUSTING DRIVING VOLTAGE VIA DIGITAL RHEOSTAT

(75) Inventors: Song-Lin Tong, Shenzhen (CN); Qi-Yan Luo, Shenzhen (CN); Peng Chen, Shenzhen (CN)

(73) Assignees: Hong Fu Jin Precision Industry (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 497 days.

(21) Appl. No.: 13/053,408

(22) Filed: Mar. 22, 2011

(65) Prior Publication Data

US 2012/0169312 A1 Jul. 5, 2012

(30) Foreign Application Priority Data

Dec. 30, 2010 (CN) ..... 2010 1 0614639

(51) Int. Cl.
*G05F 1/575* (2006.01)

(52) U.S. Cl.
USPC ..... 323/283; 323/271; 323/369

(58) Field of Classification Search
USPC ..... 323/271, 283, 297, 298, 369
See application file for complete search history.

(56) References Cited

U.S. PATENT DOCUMENTS

| | | | | |
|---|---|---|---|---|
| 6,281,665 | B1 * | 8/2001 | Miyaba et al. | 323/224 |
| 2012/0169312 | A1 * | 7/2012 | Tong et al. | 323/282 |
| 2013/0207627 | A1 * | 8/2013 | Kahn et al. | 323/271 |
| 2013/0241506 | A1 * | 9/2013 | Yang et al. | 323/282 |

* cited by examiner

*Primary Examiner* — Jeffrey Sterrett
(74) *Attorney, Agent, or Firm* — Altis Law Group, Inc.

(57) ABSTRACT

A driving voltage adjusting circuit includes a digital rheostat, a control chip, a low dropout regulating circuit, and a driving circuit. The control chip is connected with the digital rheostat, and configured for adjusting the resistance of the digital rheostat. The low dropout regulating circuit is connected with the digital rheostat and outputs an output voltage according to the resistance of the digital rheostat. The driving circuit comprising a number of switch elements connected with each other and a driver configured for driving the switch elements, each of the switch elements comprising a first terminal, a second terminal, and a control terminal configured for controlling connection and disconnection of the first terminal and the second terminal; the first terminal and the second terminal connected with the control chip, the driver is connected with the low dropout regulating circuit and output an driving voltage to the control terminal.

6 Claims, 2 Drawing Sheets

DRIVING VOLTAGE ADJUSTING CIRCUIT CAPABLE OF ADJUSTING DRIVING VOLTAGE VIA DIGITAL RHEOSTAT

BACKGROUND

1. Technical Field

The present disclosure relates to adjusting circuits and, particularly, to a driving voltage adjusting circuit capable of adjusting driving voltage.

2. Description of Related Art

A related transistor includes a drain, a source, and a gate. A driving voltage is input from the gate to control the connection and disconnection of the drain and the source. The transistor has a preset driving voltage, such as 12 v and 5 v. However, if the actual driving voltage of the gate is greater than the preset driving voltage, the voltage drop between the drain and the source may be greater than a preset value. If the actual driving voltage of the gate is lower than the preset driving voltage, the drain and the source will not be connected. Typically, driving circuits for driving the transistors connect with low dropout regulating circuits for adjusting driving voltage output from the driving circuits. To obtain a suitable driving voltage, resistors of different resistances are placed in the low dropout regulating circuits to test whether or not the driving voltage is suitable in designing the driving circuit. It is required to manually change the resistors with different resistances, which is inconvenient.

Therefore, it is desirable to provide a driving voltage adjusting circuit which can overcome the limitations described above.

DETAILED DESCRIPTION

Exemplary embodiments of the disclosure will now be described in detail, with reference to the accompanying drawing.

Figure 1:
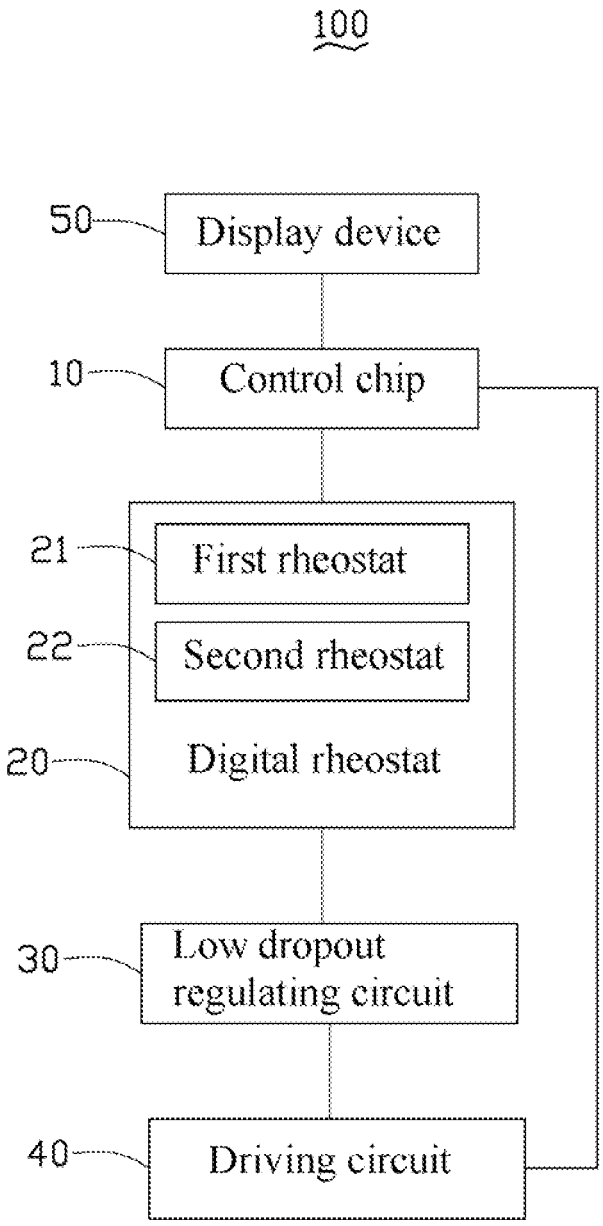
FIG. 1 is a functional block diagram of a driving voltage adjusting circuit, according to an exemplary embodiment.
Figure 2:
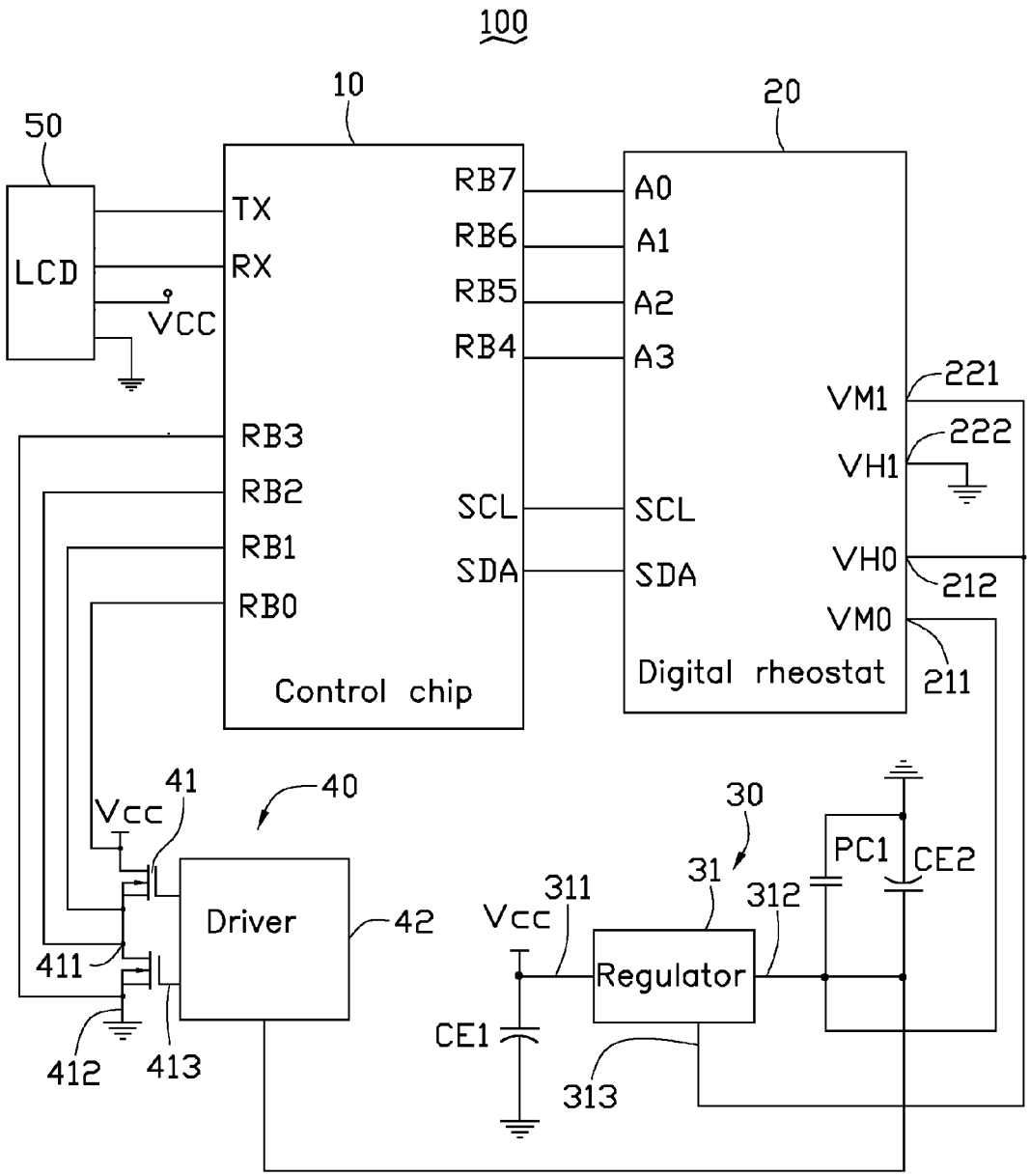
FIG. 2 is a circuit diagram of the driving voltage adjusting circuit of FIG. 1.

Referring to the FIGS. 1-2, a driving voltage adjusting circuit 100, according to an exemplary embodiment, includes a control chip 10, a digital rheostat 20, a low dropout regulating circuit 30, a driving circuit 40, and a display device 50.

The control chip 10 is a processing unit, and includes a RB0 terminal, a RB1 terminal, a RB2 terminal, a RB3 terminal, a RB4 terminal, a RB5 terminal, a RB6 terminal, a RB7 terminal, a SCL terminal, a SDA terminal, a TX terminal, and a RX terminal The RB0-RB7 terminals are input/output terminals. The SCL terminal is a serial clock terminal The SDA terminal is a serial data terminal The control chip 10 integrates a storage unit and a comparing unit. A preset voltage range is stored in the storage unit. The comparing unit is configured for receiving a voltage from an external source and comparing the voltage with the preset voltage range. The control chip 10 outputs different control signals according to a compared result of the comparing unit.

The digital rheostat 20 integrates a first rheostat 21 and a second rheostat 22. Each of the first rheostat 21 and the second rheostat 22 includes 64 adjusting points, and the maximum resistance is 10 KΩ. The first rheostat 21 includes a first sliding terminal 211 and a first fixed terminal 212. The second rheostat 22 includes a second sliding terminal 221 and a second fixed terminal 222. The digital rheostat 20 is configured for changing the number of resistors connected between the first sliding terminal 211 and the first fixed terminal 212 and between the second sliding terminal 221 and the second fixed terminal 222 to respectively change resistance of the first rheostat 21 and the second rheostat 22. The digital rheostat 20 includes an A0 terminal, an A1 terminal, an A2 terminal, an A3 terminal, an SCL terminal, an SDA terminal, a VM0 terminal, a VH0 terminal, a VM1 terminal, and a VH1 terminal The A0-A3 terminals are address terminals. The SCL terminal is a serial clock terminal The SDA terminal is a serial data terminal The VM0 terminal is the first sliding terminal 211. The VH0 terminal is the first fixed terminal 212. The VM1 terminal is the second sliding terminal 221. The VH1 terminal is the second fixed terminal 222. The A0-A3 terminals, the SCL terminal, and the SDA terminal are connected to the first rheostat 21 and the second rheostat 22, and configured for changing the resistance of the first rheostat 21 and the second rheostat 22. The A0 terminal, the A1 terminal, the A2 terminal, the A3 terminal, the SCL terminal, and the SDA terminal of the digital rheostat 20 are respectively connected with the RB7 terminal, the RB6 terminal, the RB5 terminal, the RB4 terminal, the SCL terminal, and the SDA terminal of the control chip.

The low dropout regulating circuit 30 includes a regulator 31, a first chemical capacitor CE1, a second chemical capacitor CE2, and a ceramic capacitor PC1. The regulator 31 is configured for adjusting output voltage, and includes an input terminal 311, an output terminal 312, and a feedback terminal 313. The input terminal 311 is connected with a power source Vcc, such as 12 v. The first sliding terminal 211 and the first fixed terminal 212 of the first rheostat 21 are respectively connected with the output terminal 312 and the feedback terminal 313. The second sliding terminal 221 of the second rheostat 22 is connected with the feedback terminal 313, and the second fixed terminal 222 is grounded. The first chemical capacitor CE1, the second chemical capacitor CE2, and the ceramic capacitor PC1 are configured for filtering high frequency and low frequency of the current flowing through. The first chemical capacitor CE1 includes a positive terminal connected with the input terminal 311 and a negative terminal being grounded. The second chemical capacitor CE2 includes a positive terminal connected with the output terminal 312 and a negative terminal being grounded. One end of the ceramic capacitor PC1 is connected with the output terminal 312, and other terminal is grounded.

The driving circuit 40 includes a number of switch elements 41 connected with each other and a driver 42 configured for driving the switch elements 41. Each of the switch elements 41 includes a first terminal 411, a second terminal 412, and a control terminal 43 configured for controlling the connection and disconnection of the first terminal 411 and the second terminal 412. The second terminal 412 of the ith switch element 41 is connected with the first terminal 411 of the i+1th switch element 41. The first terminal 411 of the front switch element 41 is connected with the power source Vcc. The second terminal 412 of the last switch element 41 is grounded. The first terminal 411 and the second terminal 412 of each of the switch elements 41 are connected with the control chip 10. In this exemplary embodiment, the switch element 41 is an n-channel metal oxide semiconductor (NMOS) transistor, wherein the first terminal 411 serves as a drain, the second terminal 412 serves as a source, and the control terminal 413 serves as a gate.

In this exemplary embodiment, the driving circuit 40 includes a first switch element and a second switch element. The first terminal 411 and the second terminal 412 of the first switch element are respectively connected with the RB0 terminal and RB1 terminal of the control chip 10. The first terminal 411 and the second terminal 412 of the second switch element are respectively connected with the RB2 terminal and RB2 terminal of the control chip 10. The first terminal 411 of the first switch element is connected with the power source Vcc. The second terminal 412 of the second switch element is grounded.

The display device 50 is a LCD, and connects with the TX terminal and RX terminal of the control chip 10. When a voltage drop between the first terminal 411 and the second terminal 412 of the switch element 41 is within the preset voltage range, the display device 50 displays the resistances of the first rheostat 21 and a second rheostat 22.

During the adjustment, the control chip 10 changes the resistance of the first rheostat 21 and a second rheostat 22 according to a preset program. In this exemplary embodiment, the resistances of the first rheostat 21 and the second rheostat 22 are increased from a minimum value. An output voltage output from the output terminal 312 of the regulator 31 is changed as the changing of the resistances of the first rheostat 21 and the second rheostat 22. The driver 42 outputs a driving voltage to the control terminal 413 of each of the switch elements 41 according to the output voltage output from the regulator 31. The control chip 10 acquires a voltage drop between the first terminal 411 and the second terminal 412 of each of the switch elements 41, and compares the voltage drop with the preset voltage range. When the voltage drop is out of the preset voltage range, the control chip 10 continually changes the resistance of the first rheostat 21 and the second rheostat 22. The display device 50 displays the resistances of the first rheostat 21 and the second rheostat 22, when the voltage drop is with in the preset voltage range.

It should be understood, when the resistance of the first rheostat 21 and the second rheostat 22 is determined. Two resistors which have the same resistances as the first rheostat 21 and the second rheostat 22 are connected in the low dropout regulating circuit 30. Therefore, the low dropout regulating circuit 30 corresponding to the driving circuit 40 is designed.

It will be understood that particular exemplary embodiments and methods are shown and described by way of illustration only. The principles and the features of the present disclosure may be employed in various and numerous exemplary embodiments thereof without departing from the scope of the disclosure as claimed. The above-described exemplary embodiments illustrate the scope of the disclosure but do not restrict the scope of the disclosure.

What is claimed is:

1. A driving voltage adjusting circuit, comprising:

a digital rheostat comprising a first rheostat and a second rheostat, the first rheostat comprising a first sliding terminal and a first fixed terminal, the resistance of the first rheostat changed as the number of resistors connected between the first sliding terminal and the first fixed terminal, the second rheostat comprising a second sliding terminal and a second fixed terminal, the resistance of the second rheostat changed as the number of resistors connected between the second sliding terminal and the second fixed terminal;

a low dropout regulating circuit comprising a regulator, the regulator comprising an input terminal, an output terminal and a feedback terminal; the input terminal connecting with a power source, the first sliding terminal and the first fixed terminal of the first rheostat respectively connected with the output terminal and the feedback terminal; the second sliding terminal of the second rheostat connected with the feedback terminal, and the second fixed terminal being grounded, the low dropout regulating circuit configured for outputting an output voltage according to the resistances of the first rheostat and the second rheostat;

a driving circuit comprising a number of switch elements connected with each other and a driver, each of the switch elements comprising a first terminal, a second terminal, and a control terminal configured for controlling connection and disconnection of the first terminal and the second terminal; the driver connected between the output terminal and the control terminal and configured for outputting a driving voltage from the control terminal according to the output voltage outputting from the output terminal; and a control chip connected with the digital rheostat, and configured for controlling the digital rheostat to change the resistance of the first rheostat and the second rheostat; a preset voltage range being stored in the control chip, the first terminal and the second terminal of the switch elements connected with the control chip, the control chip acquired voltage drops between the first terminal and the second terminal and comparing the voltage drop with the preset voltage range to determine whether or not the resistances of the first rheostat and the second rheostat are acceptable.

2. The driving voltage adjusting circuit in claim 1, wherein the second terminal of the ith switch element connected with the first terminal of the i+1th switch element, the first terminal of the front switch element connected with a power source, the second terminal of the last switch element being grounded.

3. The driving voltage adjusting circuit in claim 1, further comprising a display device, wherein when the resistances of the first rheostat and the second rheostat are acceptable, the display device displays the resistances of the first rheostat and the second rheostat.

4. The driving voltage adjusting circuit in claim 1, wherein the switch element is an n-channel metal oxide semiconductor (NMOS) transistor, the first terminal serves as a drain, the second terminal serves as a source, and the control terminal serves as a gate.

5. The driving voltage adjusting circuit in claim 1, wherein the low dropout regulating circuit further comprising a first chemical capacitor, a second chemical capacitor, and a ceramic capacitor, the first chemical capacitor comprising a positive terminal connected with the input terminal and a negative terminal being grounded, the second chemical capacitor comprising a positive terminal connected with the output terminal and a negative terminal being grounded, one end of the ceramic capacitor is connected with the output terminal, and other terminal is grounded.

6. The driving voltage adjusting circuit in claim 1, wherein when the voltage drop is out of the preset voltage range, the control chip continually changes the resistance of the first rheostat and the second rheostat.

* * * * *